US005083945A

United States Patent [19]

Miskin et al.

[11] Patent Number: 5,083,945

[45] Date of Patent: Jan. 28, 1992

[54] SHIELDED ELECTRICAL CONNECTOR ASSEMBLY

[75] Inventors: Michael J. Miskin, Naperville; Robert C. Brakenridge; Paul Murphy, both of Des Plaines, all of Ill.

[73] Assignee: Molex Incorporated, Lisle, Ill.

[21] Appl. No.: 649,406

[22] Filed: Feb. 1, 1991

[51] Int. Cl.[5] ..... H01R 13/648

[52] U.S. Cl. ..... 439/607; 439/108

[58] Field of Search ..... 439/92, 95, 101, 107, 439/108, 444, 676, 607, 608, 609, 610

[56] References Cited

U.S. PATENT DOCUMENTS

| | | | |
|---|---|---|---|
| 4,678,121 | 7/1987 | Douty | 439/610 |
| 4,679,879 | 7/1987 | Triner et al. | 439/425 |
| 4,695,115 | 9/1987 | Talend | 439/607 X |
| 4,838,811 | 6/1989 | Nakamura et al. | 439/610 X |
| 4,842,555 | 6/1989 | Cosmos et al. | 439/609 |
| 4,986,779 | 1/1991 | Ferrill et al. | 439/610 X |

FOREIGN PATENT DOCUMENTS

| | | | |
|---|---|---|---|
| 0266784 | 11/1988 | Japan | 439/676 |

*Primary Examiner*—Neil Abrams
*Assistant Examiner*—Khiem Nguyen
*Attorney, Agent, or Firm*—Louis A. Hecht; Charles S. Cohen; A. A. Tirva

[57] ABSTRACT

A one-piece shield is stamped and formed of metal material for substantially surrounding and shielding a dielectric housing of an electrical connector assembly. The housing is generally rectangular and includes a top, bottom, front, rear and opposite sides. The shield includes a top wall for substantially covering the top of the housing, opposite side walls for substantially covering the opposite sides of the housing, a front wall for substantially covering the front of the housing about a receptacle opening in the housing, and a rear wall for substantially covering the rear of the housing. Detent members are provided on at least one side wall and the rear wall to secure the rear wall in a closed position.

20 Claims, 2 Drawing Sheets

FIG.1
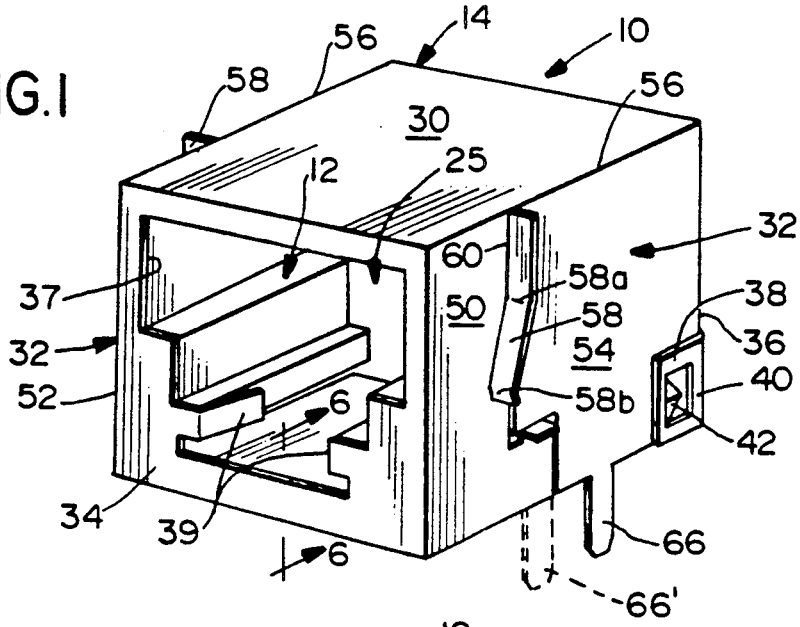
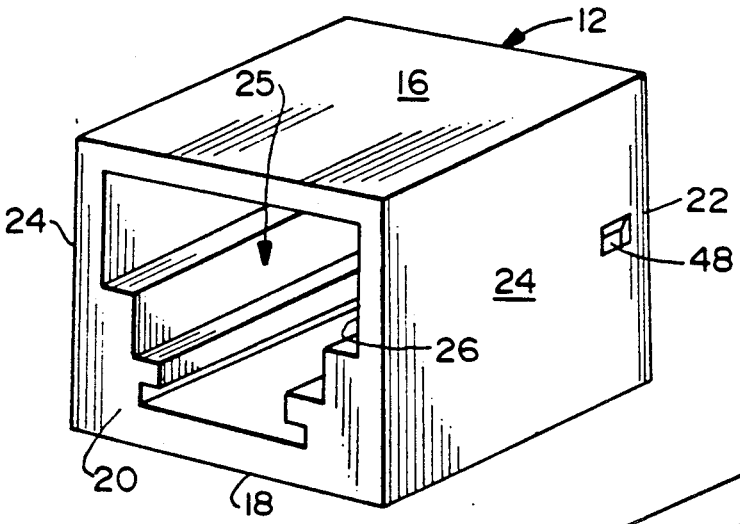
FIG.2
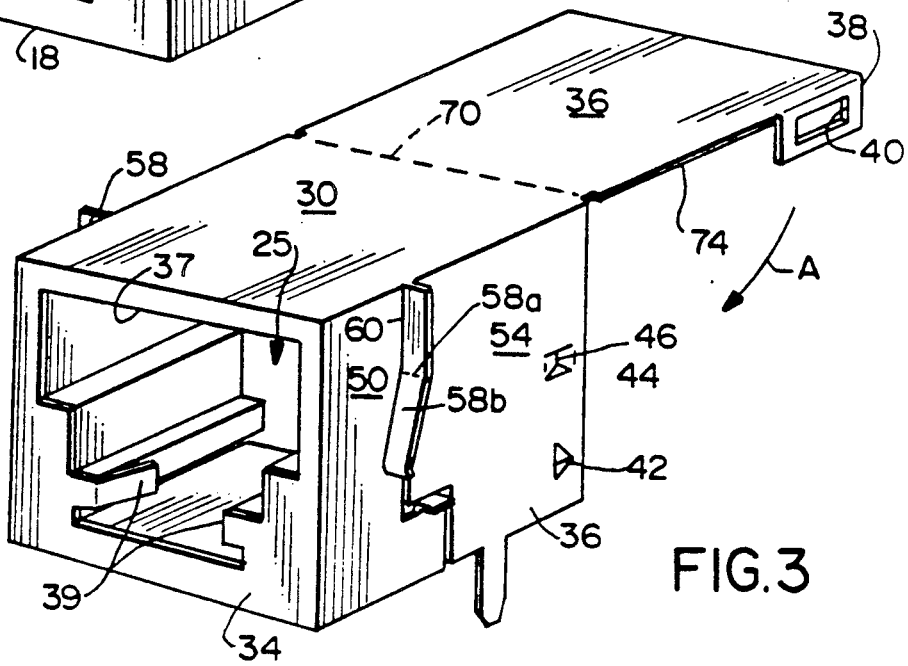
FIG.3

SHIELDED ELECTRICAL CONNECTOR ASSEMBLY

FIELD OF THE INVENTION

This invention generally relates to the art of electrical connectors and, particularly, to a shielded connector assembly providing protection against electromagnetic interference, radio frequency interference, and the like.

BACKGROUND OF THE INVENTION

Shielded electrical connector systems are used widely in such applications as telecommunications equipment, computers and other digital information systems, and the like. The electrical circuitry in such applications include electrical cables having a plurality of electrically conductive leads surrounded and protected by an electrically conductive shield, such as a braid, foil or the like. In most such applications, it is necessary to shield the signal-carrying circuits to avoid electromagnetic interference caused by energy generated outside of as well as inside the system, and/or to avoid radio frequency interference entering the system.

Many such electrical connectors are used in conjunction with systems which incorporate printed circuit boards to which the connectors are surface-mounted or with panels having apertures through which the connectors are mounted. In fact, there are applications where individual connectors must be mounted both to a printed circuit board and through an adjacent panel. Often, both the board and the panel have ground planes or plates to which the connectors are conductively coupled. The coupling usually is through the shield of the connectors.

One type of shielded electrical connector assembly is a connector or jack which is "box" or rectangularly shaped and includes a rectangularly shaped dielectric housing having the front surface and portions of the outside surrounding the front surface covered by a stamped and formed metal shield. One example of such a connector is disclosed in U.S. Pat. No. 4,679,879, which is assigned to the assignee of the present application and which is incorporated by reference herein.

With such constructions, the stamped and formed metal shields contribute considerably to the total cost of manufacturing the connectors. The cost is compounded because such connectors may be used in appreciable numbers in a single electronic device, such as a computer or a telecommunications apparatus, and the devices, themselves, are mass-produced in considerable numbers. The cost of the stamped and formed metal shields is increased whenever it is desirable to incorporate various features in the shield such as grounding means to a printed circuit board or to a panel, or both, as well as grounding means to a shield on a mating connector, as well as means to hold the various walls of the shield rigidly together in order to assemble the shield about its dielectric housing. Heretofore, there has been considerable waste metal material built into fabrication of such shields.

This invention is directed to solving the various problems outlined above by providing a very cost-effective shield for an electrical connector assembly, yet providing a shield which is extremely effective in its interference avoidance capabilities.

SUMMARY OF THE INVENTION

An object, therefore, of the invention is to provide a new and improved shielded electrical connector assembly of the character described.

In the exemplary embodiment of the invention, a one-piece shield of stamped and formed metal material is provided for substantially surrounding and shielding a dielectric housing. The housing is generally hollow for receiving a complementary mating connector through a front receptacle opening to an interior cavity mounting appropriate terminals. The dielectric housing is generally "box" or rectangularly shaped, having a top, bottom, front, rear and opposite sides.

The one-piece stamped and formed metal shield of the invention includes a top wall for substantially covering the top of the housing, opposite side walls for substantially covering the opposite sides of the housing, a front wall for substantially covering the front of the housing about the receptacle opening and a rear wall for substantially covering the rear of the housing. The rear wall includes forwardly-turned flanges along its side edges overlying the rear edges of the side walls. Complementary interengaging detent means are provided between the flanges of the rear wall and along the rear edges of the side walls for snap-engaging the rear wall with the side walls. This simple means rigidifies all of the top, side and rear walls of the shield. A bottom wall portion is bent rearwardly from a bottom edge of the front wall for covering at least a portion of the bottom of the housing and further shielding the connector assembly. The overall shield construction substantially completely surrounds the connector housing and shields circuit components on the panel and/or the printed circuit board that are covered by the shield when the complementary mating connector is removed. This reduces the electro-magnetic interference that can pass through the receptacle in either direction when the mating plug is removed.

Another feature of the invention is the provision of a spring finger formed from and projecting outwardly of each side wall of the shield for engaging a side of a panel adjacent an opening in the panel through which the connector assembly is mounted. Abutment means are formed from each side wall, spaced from the respective spring finger, for engaging the side of the panel to prevent over-stressing of the spring fingers. Preferably, the spring fingers engage a side wall of the panel which comprises a ground plane for the panel. Still further, in the illustrated embodiment of the invention, legs project downwardly from a bottom edge of each side wall for insertion into appropriate holes in a printed circuit board and may comprise grounding tabs between the shield and grounding traces on the printed circuit board.

The efficient shield of the invention contemplates that each side wall of the shield be stamped and formed by a forward portion bent rearwardly from a side edge of the front wall and a rearward portion bent downwardly from a respective side edge of the top wall. The spring fingers, the abutment means and the downwardly projecting legs all are formed from edges of the front portions of the side walls.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 1 is a perspective view of a shielded electrical connector assembly embodying the concepts of the invention;

FIG. 2 is a somewhat schematic illustration of the dielectric housing of the connector assembly;

FIG. 3 is a view similar to that of FIG. 1, illustrating the rear wall of the shield prior to being bent into final assembly;

DETAILED DESCRIPTION OF THE PREFERRED EMBODIMENT

Figure 4:
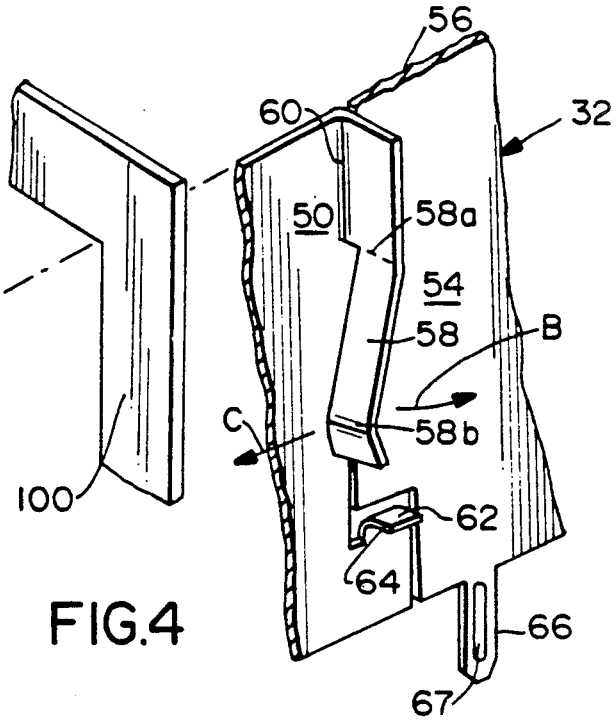
FIG. 4 is a fragmented perspective view of a portion of one of the side walls of the shield, illustrating the panel-engaging spring means, the abutment means and the depending printed circuit board grounding legs.

Referring to the drawings in greater detail, and first to FIG. 1, an electrical connector assembly, generally designated 10, includes a dielectric housing, generally designated 12, substantially surrounded by a one-piece shield, generally designated 14, of stamped and formed metal material.

Referring to FIG. 2 in conjunction with FIG. 1, it should be understood at this point that dielectric housing 12 is shown somewhat schematically because its interior configuration will depend upon the particular circuit design parameters of the connector. For instance, the connector assembly, of course, will include terminals mounted within housing 12, along with various walls, shoulders, partitions or the like to mount the terminals. For purposes of the description of the invention herein, it is sufficient to understand that housing 12 is generally "box" or rectangularly shaped and includes a top 16, a bottom 18, a front 20, a rear 22 and opposite sides 24. The front of the housing includes a mouth 26 defining a receptacle opening through which a complementary mating connector, such as a jack plug (not shown), is inserted into an interior housing cavity, as at 25. It also is sufficient to understand that, as shown in FIGS. 1 and 2, receptacle opening 26 can be quite irregularly shaped, depending upon design parameters and the appropriate mating plug connector will be complementarily shaped. As is known in the art, the mating connector conventionally will have some form of grounding means on the outside thereof providing a shield for the mating connector.

Referring back to FIG. 1, the one-piece stamped and formed metal shield 14 of the invention is shown to substantially surround dielectric housing 12. More particularly, shield 14 includes a top wall 30 substantially covering the top 16 (FIG. 2) of housing 12, opposite side walls, generally designated 32, for substantially covering the opposite sides 24 (FIG. 2) of the housing, a front wall 34 for substantially covering the front 20 (FIG. 2) of the housing about receptacle opening 26, and a rear wall 36 for substantially covering the rear 22 (FIG. 2) of the housing. Front wall 34 has an opening 37 sized and shaped complementary to receptacle opening 26 of housing 12. A pair of tabs 39 are bent inwardly along the side edges of opening 37 that engage adjacent portions of the housing on the interior of the cavity therein and contact the shield of a mating plug (not shown).

Referring to FIG. 3, in conjunction with FIG. 2, the invention contemplates complementary interengaging detent means between rear wall 36 and side walls 32 to secure the rear wall to the side walls in order to make the shield structure rigid. In the exemplary embodiment, rear wall 36 includes a pair of forwardly-turned flange portions 38 along a portion of its side edges for overlying side walls 32 adjacent their rear edges 44. As best seen in FIG. 3, the detent means are provided in the form of apertures 40 stamped out of flange portions 38 and outwardly projecting stamped and formed detent projections 42 in side walls 32 adjacent their rear edges 44. Although flange portions 38 could extend along the length of side edge 74 of rear wall 36, they are shown to only extend along a portion of the side edge. The carrier strips (not shown) connecting the shields during the stamping and forming process are located along the side edge 74 between flange portion 38 and rear edge 70 of top wall 30.

In assembly, rear wall 36 is bent downwardly from a rear edge of top wall 30, as indicated by dotted line 70, in the direction of arrow "A", whereupon detent projections 42 in the side walls snap into detent apertures 40 in flange portions 38 of the rear wall, as shown in FIG. 1. This structure increases the rigidity of the top wall, rear wall and portions (described hereinafter) of the side walls and prevents the back wall from springing back after bending. The side walls also have stamped-out and inwardly bent tabs 46 for positioning in appropriate recesses 48 (FIG. 2) in the sides 24 of housing 12 to secure the shield 14 to the housing 12.

Referring to FIG. 4 in conjunction with FIG. 1, each of side walls 32 are formed of two separate portions. More particularly, each side wall is formed from a forward portion 50 bent rearwardly from a respective side edge 52 (FIG. 1) of front wall 34, and a rearward portion 54 bent downwardly from a respective side edge 56 of top wall 30.

A spring finger 58 is formed from and projects outwardly from each side wall 32. With the two-part side wall construction of the illustrated embodiment, each spring finger is formed from and projects outwardly of an edge 60 of forward portion 50 of the side wall. This edge defines a substantial base so that spring finger 58 can yield about line **58*a* in the direction of arrow "B" (FIG. 4). If the edge 60 were substantially shorter, spring finger 58 may collapse along edge 60 rather than bend along line 58*a* as intended. Thus it is important that edge 60 be substantially longer than line 58*a*. An additional support member 61 may be provided from the front edge of rearward portion 54 that is bent perpendicular to sidewall 54 so that spring finger 58 yields about line 58*a* rather than the spring finger collapsing along edge 60**.

The spring fingers are slightly bent forwardly from the bottom of the base at **58*a*. The spring fingers are provided for engaging a side of a panel 100 adjacent an opening in the panel in which the front of connector assembly 10 is mounted. The side of the panel will have a ground plane or plate which engages spring fingers 58** to common shield 14 with the ground plane of the panel. When connector assembly 10 is inserted through the appropriate opening in the panel, as in the direction of arrow "C" (FIG. 4), the panel will engage the spring fingers, and the spring fingers will yield in the direction of arrow "B" to establish a firm contact between the spring fingers and the ground plane of the panel. To this end, each spring finger 58 is slightly bent, as at 58*b*, to provide a radius defining a contact point with the panel ground plane.

The invention contemplates the provision of abutment means formed from each side wall 32, spaced from the respective spring finger 58 for engaging the ground plane of the appropriate panel to prevent over-stressing of the spring fingers. More particularly, referring again to FIG. 4 in conjunction with FIG. 1, a tab 62 is formed out of forward portion 50 of each side wall 32 to project outwardly therefrom beneath the respective spring finger 58. It can be seen best in the detailed depiction of FIG. 4, that tab 62 has a forward edge 64 even with or slightly in front of the base of the spring finger defined by edge 60 of forward portion 50. With the spring finger slightly bent forwardly at 58*a*, contact point 58*b* is disposed forwardly of edge 64 of tab 62. Consequently, the spring finger can yield in the direction of arrow "B" to provide a biasing force against the ground plane of the panel. However, the spring finger cannot be overstressed because the panel will abut edge 64 of tab 62. In addition, the tab provides protection for the spring finger to prevent engagement with extraneous surfaces during manufacture, packaging, handling and mating of the connector.

FIGS. 1 and 4 also show a grounding leg 66 which is stamped to project downwardly from rearward portion 54 of each side wall 32. Each leg 66 has a raised oblong shaped portion or gusset 67 provided to add strength to leg 66 so as to resist bending. This leg is insertable through a mating opening in a printed circuit board for commoning shield 12 to ground traces on the printed circuit board either in the board holes or by soldering to surface grounding traces on the board. In the alternative, the grounding legs could project downwardly from forward portion 50, as shown in phantom at 66' in FIG. 1. A further alternative (not shown) provides that the legs 66 have a portion adjacent the bottom of side wall 54 bent perpendicular to the side wall. Rather than projecting through the printed circuit board, the legs 66 would be soldered to the surface of the printed circuit board in known manner.

Figure 5:
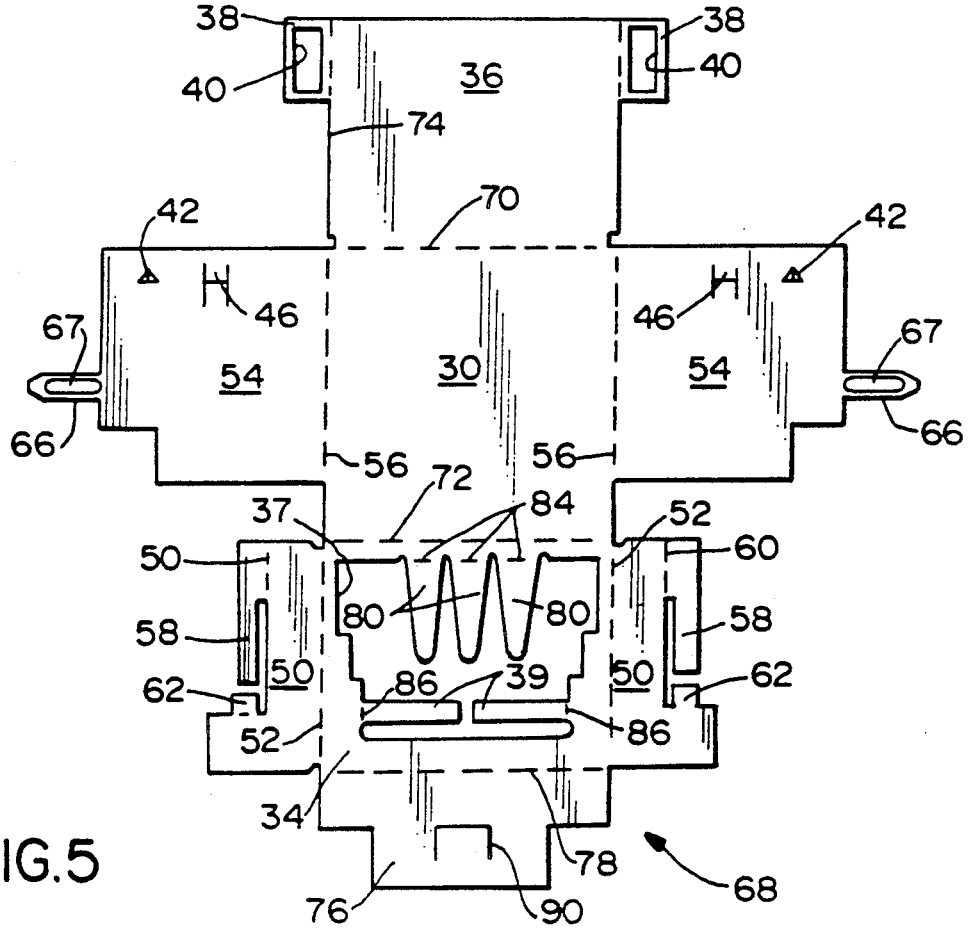
FIG. 5 shows a stamped blank of sheet metal material from which the shield of the invention is formed.

Referring to FIG. 5, a blank 68 is shown as stamped and formed from sheet metal material in a single piece to form shield 14 therefrom. Like numerals have been applied to FIG. 5 corresponding to the above descriptions of FIGS. 1, 3 and 4. Consequently, it can be understood that back wall 36 of the shield is bent downwardly from a rear edge 70 of top wall 30, front wall 34 is bent downwardly from a front edge 72 of the top wall, and rearward portions 54 of the side walls also are bent downwardly from edges 56 of the top wall. Flanges 38 along the sides of rear wall 36 also are shown in the blank for bending forwardly along side edges 74 of the rear wall. It can be seen that forward portions 50 of the side walls are stamped to be bent rearwardly of front wall 34 along edges 52, and that spring fingers 58, tabs 62 and grounding legs 66 all are formed from forward portions 50 of the side walls which, in turn, are formed from the side edges of front wall 34. Detent projections 42 and tabs 46 are shown in proper positions stamped and/or punched from the blank in rearward portions 54 of the side walls. Likewise, detent recesses 40 are shown in proper positions stamped out of flanges 38. By this stamped and formed configuration, it can be seen that blank 68 is extremely compact in its extreme bounds to reduce to a bare minimum the amount of waste metal material from the sheet metal of which the blank is stamped, yet providing all of the features described above.

In production, the shield is initially stamped and formed so that it is in the configuration shown in FIG. 3. The insulative housing 12 is then inserted into the shield from the rear either manually or by machine and back wall 36 is then bent downward either manually or by machine until it locks in place as shown in FIG. 1. Thus, through this configuration, the shield can be closed with only one bending operation after the housing is positioned within the shield.

In an alternative configuration, the back wall 36 would not extend off of top wall 30 but rather from edge 44 of one side wall 32. Back wall 36 would then only have one flange 38 and side wall 32 only one set of detent projections 42. After stamping and forming but prior to closing the shield, the shield 12 would be identical to that of FIG. 3 except that back wall 36 would be co-planar with one of side walls 32 rather than top wall 30 and only one set of latching mechanisms would be provided. After the housing is inserted, the back wall 36 would be bent along rear edge 44 of the side wall 32 until it is perpendicular to the side wall and the projections 42 of the flange 38 mate with recesses 40 to secure the back wall.

Figure 6:
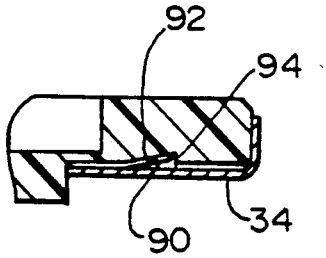
FIG. 6 is a partial sectional view taken along line 6—6 of FIG. 1.

Referring to FIGS. 5 and 6, although not visible in the previous Figures, shield 14 includes a bottom wall 76 which is bent rearwardly along a bottom edge 78 of front wall 34 for covering a front portion of bottom 18 (FIG. 2) of dielectric housing 12. A barb 90 in the bottom wall 34 may also be provided that extends upwardly towards the housing 12. An indentation 92 (FIG. 6) is located in the bottom of housing 12 to create a shoulder 94 into which barb 90 projects when the shield 14 is positioned over the housing. This structure assists in maintaining the shield on the housing during unlatching of a mating plug from receptacle 10. In addition, a plurality of grounding fingers 80 are stamped from an upper edge 82 of opening 37 in front wall 34. These grounding fingers are bent slightly downwardly, as at 84, into the cavity of dielectric housing 12 for biasingly engaging and commoning shield 14 to an appropriate exterior shield or ground on the mating connector. Finally, tabs 39 are shown projecting inwardly from opening 37 for bending rearwardly of front wall 34, as at 86.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In an electrical connector assembly which includes a generally rectangular dielectric housing having a top, bottom, front, rear and opposite sides, the front of the housing defining a generally rectangular receptacle opening for receiving a generally rectangular mating connector, a one-piece shield of stamped and formed metal material for substantially surrounding and shielding the dielectric housing, comprising:

a top wall for substantially entirely covering the top of the housing;

opposite side walls for substantially entirely covering the opposite sides of the housing;

a front wall for substantially entirely covering the front of the housing about said receptacle opening;

a rear wall for substantially entirely covering the rear of the housing; and first and second complementary interengaging detent means, said first means being located along the rear edge of at least one of the side walls and said second means being located adjacent an edge of the rear wall for snap-engaging with said first means to secure the rear wall with at least one of the side walls.

2. The electrical connector assembly of claim 1 wherein said rear wall includes a forwardly turned flange along said adjacent edge overlying said at least one side wall, with said detent means being disposed in the flange.

3. The electrical connector assembly of claim 1 wherein each of said side walls is formed by a forward portion bent rearwardly from a respective side edge of the front wall and a rearward portion bent downwardly from a respective side edge of the top wall.

4. The electrical connector assembly of claim 3, including legs projecting from a bottom edge of the rearward portion of each side wall for insertion into appropriate holes in a printed circuit board.

5. The electrical connector assembly of claim 1, including a spring finger formed from and projecting outwardly of each of said side walls for engaging a side of a panel adjacent an opening in the panel in which the connector assembly is mounted, and abutment means formed from each side wall, spaced from the respective spring finger, for engaging said side of the panel to prevent over-stressing of the spring fingers.

6. The electrical connector assembly of claim 5 wherein each said side walls are formed by a forward portion bent rearwardly from a respective side edge of the front wall and a rearward portion bent downwardly from a respective side edge of the top wall, and said spring fingers and said abutment means are formed from and project outwardly from the forward portions of the side walls.

7. The electrical connector assembly of claim 1, including a bottom wall for covering at least a portion of the bottom of the housing.

8. The electrical connector assembly of claim 7 wherein said bottom wall is bent rearwardly from a bottom edge of the front wall and said bottom wall includes a barb portion inclined towards the rear wall and associated with a shoulder in the bottom of said housing.

9. The electrical connector assembly of claim 1 wherein said front wall, said rear wall and at least portions of said side walls all are bent downwardly from a front edge, a rear edge and side edges, respectively, of the top wall.

10. The electrical connector assembly of claim 9, including a bottom wall bent rearwardly from a bottom edge of the front wall for covering at least a portion of the bottom of the housing.

11. In an electrical connector assembly which includes a generally rectangular dielectric housing having a top, bottom, front, rear and opposite sides, the front of the housing defining a receptacle opening for receiving a mating connector, a one-piece shield of stamped and formed metal material for substantially surrounding and shielding the dielectric housing, comprising:

a top wall for substantially entirely covering the top of the housing;

a front wall for substantially entirely covering the front of the housing about said receptacle opening;

or bottom wall for covering at least a portion of the bottom of the housing;

opposite side walls for substantially entirely covering the opposite sides of the housing;

a rear wall for substantially entirely covering rear of the housing, the rear wall including a forwardly turned flange along a side edge overlying an adjacent rear edge of one of said side walls; and means for locking said flange to one of said side walls for securing the rear wall to the side wall.

12. The electrical connector assembly of claim 11, wherein each of said side walls is formed by a forward portion bent rearwardly from a respective side edge the front wall and a rearward portion bent downwardly from a respective side edge of the top wall.

13. The electrical connector assembly of claim 12, further including legs projecting from a bottom edge of the rearward portion of each side wall for insertion into appropriate holes in a printed circuit board.

14. The electrical connector assembly of claim 11, including a spring finger formed from and projecting outwardly of each of said side walls for engaging a side of a panel adjacent an opening in the panel in which the connector assembly is mounted, and abutment means formed from each side wall, spaced from the respective spring finger, for engaging said side of the panel to prevent over-stressing of the spring fingers.

15. The electrical connector assembly of claim 14 wherein each said side walls are formed by a forward portion bent rearwardly from a respective side edge of the front wall and a rearward portion bent downwardly from a respective side edge of the top wall, and said spring fingers and said abutment means are formed from and project outwardly from the forward portions of the side walls.

16. In an electrical connector assembly which includes a generally rectangular dielectric housing having a top, bottom, front, rear and opposite sides, the front of the housing defining a receptacle opening for receiving a mating connector, a one-piece shield of stamped and formed metal material for substantially surrounding and shielding the dielectric housing, comprising:

a top wall for substantially entirely covering the top of the housing;

opposite side walls for substantially entirely covering the opposite sides of the housing;

a spring finger formed from and projecting outwardly of each of said side walls for engaging a side of a panel adjacent an opening in the panel in which the connector assembly is mounted; and abutment means formed from each side wall, spaced from the respective spring finger, for engaging said side of the panel to prevent over-stressing of the spring fingers.

17. The electrical connector assembly of claim 16, including a front wall for covering at least a portion o the front of the housing, and said side walls being formed, in part, by a forward portion bent rearwardly from a respective side edge of the front wall.

18. The electrical connector assembly of claim 17, further comprising a rear wall for substantially covering the rear wall of said housing.

19. The electrical connector assembly of claim 17 wherein said spring fingers and said abutment means are formed from and project outwardly from said forward portions of the side walls.

20. The one-piece shield of claim 17, including a leg projecting downwardly from a bottom edge of a rearward portion of each side wall for insertion into appropriate holes in a printed circuit board.

* * * * *